United States Patent [19]

Randell

[11] 3,976,391

[45] Aug. 24, 1976

[54] ROTODYNAMIC FLUID PUMPS

[75] Inventor: Forrest Thomson Randell, Glasgow, Scotland

[73] Assignee: Weir Pumps Limited, Glasgow, Scotland

[22] Filed: Apr. 30, 1975

[21] Appl. No.: 573,160

[30] Foreign Application Priority Data

May 9, 1974 United Kingdom ..... 20412/74

[52] U.S. Cl. ..... 415/53 R; 415/175

[51] Int. Cl.[2] ..... F04D 5/00

[58] Field of Search ..... 415/111, 112, 175, 176, 415/53

[56] References Cited

UNITED STATES PATENTS

| | | | |
|---|---|---|---|
| 2,283,131 | 5/1942 | Shaw et al. | 415/176 |
| 3,651,866 | 3/1972 | Lileg et al. | 415/112 |
| 3,677,659 | 7/1972 | Williams | 415/111 |
| 3,758,226 | 9/1973 | Gyurech | 415/175 |
| 3,811,789 | 5/1974 | Randell | 415/53 |

FOREIGN PATENTS OR APPLICATIONS

| | | | |
|---|---|---|---|
| 205,865 | 10/1959 | Austria | 415/175 |
| 500,808 | 1/1920 | France | 415/111 |
| 276,593 | 7/1914 | Germany | 415/53 |

*Primary Examiner*—Henry F. Raduazo
*Attorney, Agent, or Firm*—Mason, Fenwick & Lawrence

[57] ABSTRACT

A centrifugal fluid pump includes a casing housing an impeller having a suction eye, an axial fluid inlet to the impeller eye, a fluid discharge, and a recirculation line for recycling leakage liquid from the casing to the fluid inlet to minimise the risk of cavitation occurring at the impeller eye. A heat exchanger is located in the recirculation line for cooling the recycled leakage liquid and has control means associated therewith. The recycled liquid is introduced by a duct into the fluid inlet close to the impeller eye with an axial component of flow so that disturbance to flow in the inlet is reduced. In particular, the recirculation line may discharge into an annular velocity stabilising chamber at the fluid inlet, and a frusto-conical passage delivers the liquid from the chamber to the fluid inlet.

3 Claims, 2 Drawing Figures

ROTODYNAMIC FLUID PUMPS

The present invention relates to a centrifugal fluid pump of the type described in U.S. Pat. No. 3,811,789 dated May 21, 1974, of the present Applicant F. T. Randell, such a pump including a casing housing an impeller having a suction eye, an axial fluid inlet to the impeller eye and a fluid discharge, a recirculation line for recycling leakage liquid from the casing to the fluid inlet, a heat exchanger in the recirculation line for cooling the recycled leakage liquid, and control means for regulating heat exchange in the heat exchanger.

In a centrifugal pump of the above type, cooled leakage liquid is recycled to the fluid inlet via the recirculation line for the purpose of avoiding cavitation at the pump impeller. Cavitation is particularly prone at the impeller at low pump loads, and in one particular form of the aforesaid pump, the control means is responsive to the pump discharge rate and operates to cool the leakage liquid when the discharge rate falls below a predetermined value. However, previously the recirculation line discharged recycled leakage liquid directly into the fluid inlet in a radial direction upstream of an impeller suction eye. This directly discharged radial leakage flow impinging on the axially flowing liquid in the inlet had the disadvantage of disturbing the flow pattern of the axial inlet flow. In particular it has been found that disturbance of the flow pattern of the inlet fluid increases the risk of cavitation at the impeller eye.

It is an object of the present invention to obviate or mitigate this disadvantage.

According to the present invention in a centrifugal pump of a type aforesaid there are provided a chamber receiving leakage liquid from the recirculation line and having an internal volume sufficient to stabilize the leakage liquid, and a discharge passage from the chamber for delivery of the leakage liquid to the periphery of the fluid inlet and close to the eye of the impeller, the discharge passage being arranged to impart an axial component of flow to the leakage liquid relative to fluid flow in the fluid inlet so that disturbance to the flow is reduced.

An embodiment of the present invention will now be described by way of example with reference to the accompanying drawings in which.

Figure 1:
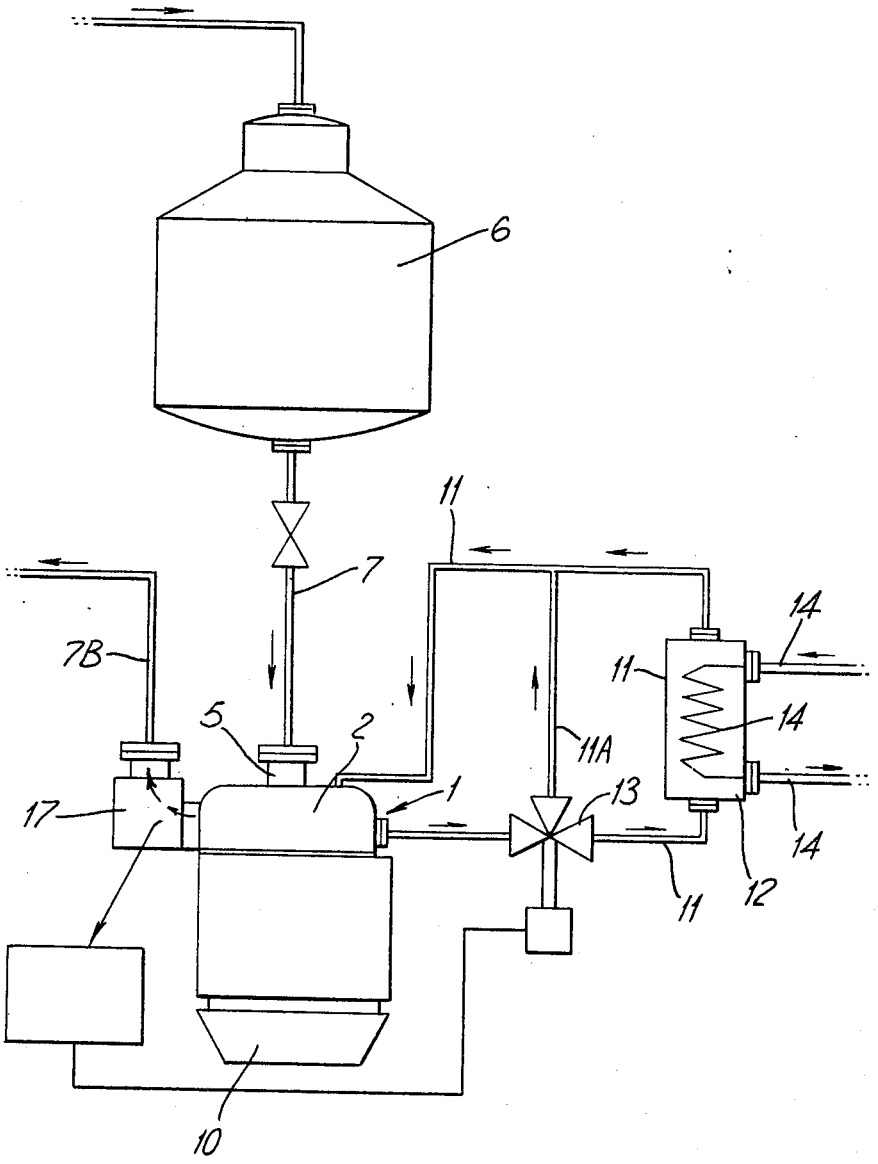
FIG. 1 shows a schematic view of a centrifugal pump installation.
Figure 2:
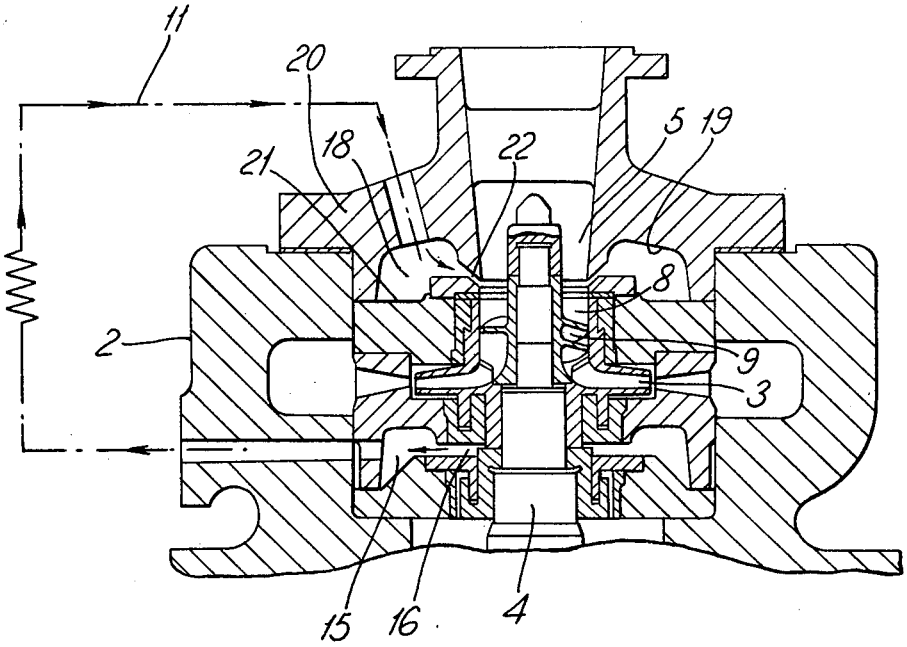
FIG. 2 is a cross sectional view of part of the pump of FIG. 1 showing details of the leakage liquid return to the pump suction.

Referring to the drawings, a centrifugal pump 1 has a pump casing 2 housing an impeller 3 (FIG. 2) mounted on an impeller shaft 4 but the pump may be a multistage pump including a plurality of impellers arranged in series. A suction inlet 5 of the pump 1 receives feed liquid (water) from a liquid reservoir 6, for example a de-aerator, via a supply pipeline 7 while the discharge from the pump is delivered say to a boiler via a discharge pipe 7B. The suction inlet 5 delivers the feed water axially to an eye 8 of the impeller 3 and the water is discharged radially outwards by the impeller 3, as is conventional. The impeller shaft 4 additionally includes preliminary pressurising vanes 9 before the eye of the impeller proper, and in this specification the eye of the impeller is considered to embrace the zone at the inlet to these pressurising vanes. The pump 1 is driven by any suitable drive 10, for example a steam turbine.

As shown in the aforesaid U.S. Pat. No. 3,811,789, to avoid cavitation in the feed water in the pump 1 at low pump loads leakage liquid is recycled by a recirculation line 11 from the pump casing 2 to the suction inlet 5, and this recirculation line includes a heat exchanger 12 to cool the leakage liquid at low pump loads. In a preferred arrangement, the recirculation line 11 includes a line 11A by-passing the heat exchanger 12, and a valve 13 controls the leakage flow either to pass through the heat exchanger 12 or to by-pass the heat exchanger via line 11A, but portions of leakage liquid could be delivered through the by-pass 11A and the heat exchanger 12. A steady predetermined flow of cooling fluid (water) is supplied to a cooling conduit 14 of the heat exchanger 12. The recirculation line 11 receives leakage liquid from a leakage chamber 15 at the high pressure end of the pump, entry to this chamber 15 being via an expansion passage 16 so that the leakage liquid passing to the chamber 15 is reduced in pressure.

The control valve 13 is operatively coupled to a flow sensor 17 at the discharge of the pump 1, to recycle leakage liquid direct to the inlet 5 via the by-pass line 11A but at low pump loads to divert the leakage liquid through the heat exchanger 12 for cooling prior to discharge into the pump inlet 5 thus protecting the pump from handling saturated fluid. The arrangement is particularly advantageous in installations where sea water is used for the cooling water in the heat exchanger and where the temperature of the leakage liquid can be high (212°F.), since by directing the hot leakage liquid past the heat exchanger 12 for the greater portion of the pump operating time, the possibility of salt formation on the cooling conduit 14 of the heat exchanger 12 is reduced.

In the present embodiment, the leakage liquid is fed to an annular chamber 18 (FIG. 2) at the inlet end 5 of the pump very close to the eye 8 of the impeller, the chamber 18 being formed by an annular recess 19 in an end suction cover 20 of the pump and a transverse end wall 21 of the impeller casing 2 adjoining the suction cover 20, and an annular clearance passage 22 directs leakage liquid from the chamber 18 into the pump suction inlet 5 very close to the eye 8 of the impeller. The chamber 18 which is co-axial with the suction inlet 5 serves to stabilise the leakage liquid by reducing the velocity of the liquid prior to entry to the suction inlet 5, and the annular clearance passage 22 is inclined relative to the axis of the suction inlet so as to be in effect of frusto-conical form with a cone angle pointing inwardly of the pump and so that the leakage flow is directed in a path having a directional component parallel to the suction inlet 5. The arrangement is such that an annular flow of relatively low velocity leakage liquid is passed by the annular passage to blend smoothly with the peripheral portion of feed water in the suction inlet and very close to the eye 8 of the impeller. In the previous arrangements, the leakage liquid was discharged into a peripheral zone of the suction feed water as a radial "jet" of relatively high velocity liquid. It is believed that cavitation is most likely to occur at the peripheral portions of the suction feed. The aforementioned jet of liquid will considerably disturb the peripheral zone of the feed and such a disturbance will considerably encourage the occurrence of cavitation at the feed periphery. The arrangement of the present invention considerably reduces disturbance to the peripheral portions of the suction feed water and consequently assists in preventing cavitation in the pump. In particular, the leakage liquid can be returned very close to the eye of the impeller, without causing the cavitation characteristic of the impeller to be impaired: indeed the risk of cavitation is actually reduced since the recirculated flow stimulates a stabilised boundary layer in the flow into the impeller eye.

Whereas the above embodiment of the present invention describes a control valve operatively coupled to a flow measurer at the pump discharge, it would be possible additionally or alternatively to have the control valve operable through a fluid temperature sensor say located at a section of the recirculation line upstream of the valve.

I claim:

1. A centrifugal pump including a casing housing an impeller having a suction eye, an axial fluid inlet to the impeller eye and a fluid discharge, a recirculation line for recycling leakage liquid from the casing to the fluid inlet, a heat exchanger in the recirculation line for cooling the recycled leakage liquid, control menas for regulating heat exchange in the heat exchanger, a chamber receiving leakage liquid from the recirculation line and having an internal volume sufficient to stabilise the leakage liquid, and a discharge passage from the chamber for delivery of the leakage liquid to the periphery of the fluid inlet and close to the eye of the impeller, the discharge passage being arranged to impart an axial component of flow to the leakage liquid relative to fluid flow in the fluid inlet so that disturbance to the flow is reduced.

2. A centrifugal pump as claimed in claim 1, wherein the said chamber is constituted by an annular chamber at the inlet end of the pump casing and surrounding the impeller shaft, and the discharge passage is comprised by a clearance passage of frusto-conical form having a cone angle pointing inwardly of the pump.

3. A centrifugal pump as claimed in claim 1, wherein said chamber is formed by a recess in a front cover of the pump.

* * * * *